US008657708B2

(12) United States Patent
Pijanowski

(10) Patent No.: US 8,657,708 B2
(45) Date of Patent: Feb. 25, 2014

(54) PORTABLE TARGET GAME TRAINING DEVICE

(76) Inventor: Jerry Pijanowski, Glenview, IL (US)

( * ) Notice: Subject to any disclaimer, the term of this patent is extended or adjusted under 35 U.S.C. 154(b) by 182 days.

(21) Appl. No.: 13/266,453

(22) PCT Filed: Apr. 27, 2010

(86) PCT No.: PCT/US2010/032639

§ 371 (c)(1),
(2), (4) Date: Oct. 26, 2011

(87) PCT Pub. No.: WO2010/126918

PCT Pub. Date: Nov. 4, 2010

(65) Prior Publication Data

US 2012/0052988 A1 Mar. 1, 2012

Related U.S. Application Data

(60) Provisional application No. 61/214,636, filed on Apr. 27, 2009.

(51) Int. Cl.
*A63B 69/38* (2006.01)

(52) U.S. Cl.
USPC ..... 473/430; 473/422; 473/459

(58) Field of Classification Search
USPC ..... 473/422, 423, 427, 429, 430, 451, 459
See application file for complete search history.

(56) References Cited

U.S. PATENT DOCUMENTS

| | | | | | |
|---|---|---|---|---|---|
| 4,175,744 | A * | 11/1979 | Llewellyn | 473/149 |
| 4,555,110 | A * | 11/1985 | Hai-Ping | 473/149 |
| 5,531,438 | A * | 7/1996 | Corley | 473/429 |
| 5,618,039 | A * | 4/1997 | Tsai et al. | 473/423 |
| 6,296,582 | B1 * | 10/2001 | Minniear | 473/428 |
| 6,390,939 | B1 * | 5/2002 | Palacios | 473/422 |
| 6,458,037 | B1 * | 10/2002 | Dixon, Jr. | 473/219 |
| 8,137,218 | B2 * | 3/2012 | Le niewicz | 473/430 |
| 2013/0012340 | A1 * | 1/2013 | Kanner et al. | 473/429 |
| 2013/0053188 | A1 * | 2/2013 | Moore | 473/423 |

* cited by examiner

*Primary Examiner* — Mitra Aryanpour

(57) ABSTRACT

A Portable Target Game Training Device for training play by a user that elevates a target comprised of a base, a stand connected to the base, a rotatable shaft connected to the stand, an arm connected to the rotatable shaft connection means between the arm and the rotatable shaft and a target secured to the remote end of the arm. The arm can be forced to bow by tethered cords connected to the rotatable shaft. When the target is hit, the arm, the cords and the shaft rotate. The speed and character of rotation and counter rotation is governed by stretching and easing an elastic cord connected to the base of the device and the top of the rotatable shaft. The angle of the shaft vis a vis the stand may be adjusted. The height of the stand may be adjusted.

1 Claim, 7 Drawing Sheets

PORTABLE TARGET GAME TRAINING DEVICE

PRIORITY CLAIM

This application is a Section 371 National Phase application of PCT/US2010/032639 filed 27 Apr. 2010 which draw priority from U.S. Provisional Patent Application Ser. No. 61/214,636 filed 27 Apr. 2009, entitled Ball Striking Training Machine.

BACKGROUND OF THE INVENTION

The present invention relates to a portable target game training device particularly but not exclusively for practicing and correcting tennis strokes and as well as developing proper form and muscle tone and memory. The device can also be used for badminton, baseball, volleyball or any other sport where the object is hit a ball or a birdie or other target. Various devices have been developed for the purpose of simulating the stroking of a sport ball or sport target. Many of these devices seek to mimic tennis play. The object of such devices is to provide the realistic "feel" along with the repetition needed perfect strokes and skills.

Prior art tennis training or practice devices have suffered from various combinations of disadvantages: high cost, lack of portability, need for electricity to run an electric mechanism, large weight, lack of versatility, unrealistic response or "feel", complex assembly and/or disassembly, time consuming assembly or disassembly. Other problems faced in providing a successful training device are trying to mimic the actual flight of the target, controlling speed of the target, height and trajectory of the target.

This invention provides the solution with a portable, non-electric, lightweight apparatus that provides easy mobility, usage and storage, realistic "feel" during play, adjustment to speed of rotation and counter—rotation of the target, adjustment of the angle of the arc of rotation and counter—rotation of the target, adjustment of the height of the target during rotation and counter-rotation.

OBJECTS OF THE INVENTION

The objects of this invention are:

1. to provide a training device that is portable weighing about ten pounds;
2. to provide a training device that compacts to about the length of a tennis racket and could be transported or stored in a typical multi-racket tennis tote bag;
3. to provide a training device that mimics the play of hitting a tennis ball or other target where a player hits the target and then the opponent returns the target;
4. to provide a training device that allows for adjustment of angle of the trajectory of rotation and counter rotation so that the player may adjust the arc or trajectory of rotation to practice various aspects of play including acute angles between the stand and the axis of trajectory of rotation for practice of overhead shots or volleys in tennis or badminton; or,
5. to provide a training device that allows for adjustment of height to accommodate taller and shorter players or a player that desires to train for a particular height of play such as low ground strokes in tennis.

SUMMARY OF THE INVENTION

The present invention is directed to a portable target game training device. The device is comprised of a main support system or stand and an integral target suspension system. The stand provides a foldable base and vertical telescoping tubular shaft that includes a height adjustment mechanism. Extending essentially vertically from the stand is an integral target suspension system which may be rotated and inclined by an angle adjustment mechanism. When a target, mounted at the end of the suspension support arm or arm, is struck, the target, arm, and an upper inclined vertical shaft also called "rotatable shaft" rotate about an axis in line with the rotatable shaft. The rotation is limited by an elastic cord that is connected to one or two of the cross shaped legs also known as "legs" in the base and to one or more of four slots notched in the top ring mounted to the extreme end of the rotatable shaft. The elastic cord can also be set in a triangular manner from one leg to the top ring on the rotatable shaft and then down to a different leg. When the rotatable shaft is rotated, the elastic cord will wrap around a collar below said top ring. The collar is not essential to performance of the device but the semi-hard foam of the collar used in the preferred embodiment affects the rotation and counter-rotation of the device and hence the "feel" of the device in use. Instead of semi-hard foam, one might use any surface that provides friction to engage the elastic cord.

In play, the user hits the target attached to the arm and the rotation stretches the elastic cord and winds it around the rotatable shaft. The arm is held in place on the rotatable shaft side by a socket mounted on the rotatable shaft with screws or other fasteners. The rotatable shaft is drilled to provide two holes in line on shaft so that a tethered cord can be fed through each hole. The tethered cord is knotted to prevent it from pulling through each hole. The arm is collapsible to about 24 inches. When extended the arm is about 46 inches. The tethered cord is typically tied to so as to provide a loop that bows the arm. The tethered cord may be adjusted to cause more or less bowing of the arm. At the inboard end of the arm is a pin that fits in a socket on the rotatable shaft to hold the arm in place. The arm on the outboard end has a substantially spherical shaped member or orb. The orb has two pins or prongs sticking out in line with the arm when not bowed. On the tethered cord is secured a sling. The sling is sewed or otherwise secured. A holding device holds the target. The holding device has a loop that is fitted between the pins on the orb and the sling and tethered cord cause the arm to bow. The pressure of the bowing arm against the sling and tethered cord assembly hold the holding device in place. The extent of bowing the arm changes the "feel" of play because the target is oriented forward as the bowing increases. The bowing is increased by knotting the tethered cord shorter.

The elastic cord is cleated to a cleat attached to the end of one or two legs on the base. If the user of the device wanted to increase the speed of the target as it rotated and the lightness of the target as it rotated, then he would increase the tension of the elastic cord and secure additional remaining elastic cord on an available cleat.

The user by selecting the position of the elastic cord in the slots on the top ring effects the resting position of the suspension support arm and therefore the feel of play. Considered from the vantage of looking down on the rotatable shaft, one can appreciate how an adjustment of the elastic cord on the top ring can affect the play. The top ring has four slots evenly spaced on the circumference of the ring. Looking down the rotatable shaft one can see the placement of those slots relative to the point where the arm is mounted on the rotatable shaft. When using the device the user can elect by placement of the elastic cord in the slots and relative to the connection point of the arm to the rotatable shaft the natural resting place of the arm and the shaft. The manipulation of the resting place is another way that the user can change the feel of the device in play.

The arm can be angularly adjusted to control target trajectory of rotation. The angle between of the main support system and the integral target suspension system may be changed. One set of angles is appropriate for practicing forehand and backhand ground strokes. By making the angle more acute and by raising the main support system, a user may practice overhead smashes and other overhead play.

The arm is held in a bowed shape such that the bow of the arm is away from the target and the basket in which the target rides. The arm connects on one side to the rotatable shaft. The end of the arm interacts with a tethered cord, typically nylon, connected to the rotatable shaft just below the top ring and below the socket into which the arm fit in the rotatable shaft. The socket was about equidistant from the two points where the tethered cord is attached to the rotatable shaft. The bowing of the arm is achieved by capturing the remote tip of the arm with the tethered cord. At the point of capture a sling made of leather or similar material that is fastened to the tethered cord, attached the arm, sling and tethered cord and a basket holding a sports target. The bowing of the arm benefits the user of the Portable Target Game Training Device as a user can protect an expensive racket from being damaged by hitting the arm. Instead, the user only hits either the target, the basket holding the target or the tethered cords, all of which are soft. The user can easily switch from forehand to backhand by merely reversing the bow of the arm.

The rotatable shaft is fitted with a socket. The arm has a pin that goes through the arm and protrudes from each side. The pin acts as a guide when it fits into the socket. The socket has two grooves on either side of the socket. The pin on the arm fit snugly into the grooves. The interaction of the pin and grooves stopped the arm from rotating in the socket.

The arm telescopes so as to be more compact for transport. The arm is in two lengths. The more remote length nests into the length that connects to the rotatable shaft. When extended, the remote length is held in place by a two retractable spring-loaded pins that when extended would lock into two grooves on the inboard length of the arm.

The Portable Target Game Training Device is made to be portable. To aid in portability the machine comes with a water-filled base weight. The water-filled base weight is a collapsible bladder that the user would fill with water when he set up the machine. Typically ball training machines used sand bags or metal weights to stabilize the machine for use. The machines require stabilization due to the force of impact when a user strikes the ball. The current invention allows the user to have a light weight apparatus that the user may carry to the place of use and then fill with water. After use, the user would empty the water-filled base and store for transport.

The arm must be of a material that is strong, flexible and light. The inventor has used graphite, fiberglass, carbon and other composite materials about a half-inch diameter at base tapering to a about a ⅜'s of an inch. The inventor has used carbon and fiberglass arms.

There is a relationship between the tethered cord and the arm. In the preferred embodiment, the rotatable shaft is about 24-inches long. The arm is about 24-inches long when collapsed and about 46-inches long when extended. The tethered cord may be any length such that it will cause bowing of the arm when assembled. The amount of bowing may be set by the user by shortening the tethered cord. Different amounts of bowing provide for a different experience striking the target for the user. In the preferred embodiment, the suspension support arm would bow about six inches from the plane established by the tethered cords when the apparatus is assembled. In the preferred embodiment, the legs, shafts and metal connectors are made of aluminum or another light weight but strong metal so as to be easier to transport. Below the top ring is a collar. The collar must be of greater diameter than the upper inclined vertical shaft. In the preferred embodiment, the collar is made of a dense foam that the elastic cord grips when the shaft rotates. The collar, though, could be of any material that grips the elastic cord. The tethered cord is attached to the top and bottom of the rotatable shaft. The rotatable shaft shaft is drilled so that the tethered cord may be fed through the rotatable shaft. The length of the tethered cord may be shorted or lengthened by pulling tethered cord through the rotatable shaft and then knotting the tethered cord. By shortening the tethered cord, the user can cause the arm to be more bowed.

BRIEF DESCRIPTION OF THE DRAWINGS

The advantages, features and operation of this invention will be better understood from reading of the following detailed description of the drawings in conjunction with the accompanying drawings in which like numerals refer to like elements and in which.

DETAILED DESCRIPTION OF THE DRAWINGS

With reference to the accompanying drawings, the present invention of the Portable Target Game Training Device will now be described more fully in which a preferred embodiment of the invention is shown. This invention may, however be embodied in many different forms and should not be construed as limited to the embodiment described. Like numbers refer to like elements throughout the figures.

Figure 1:
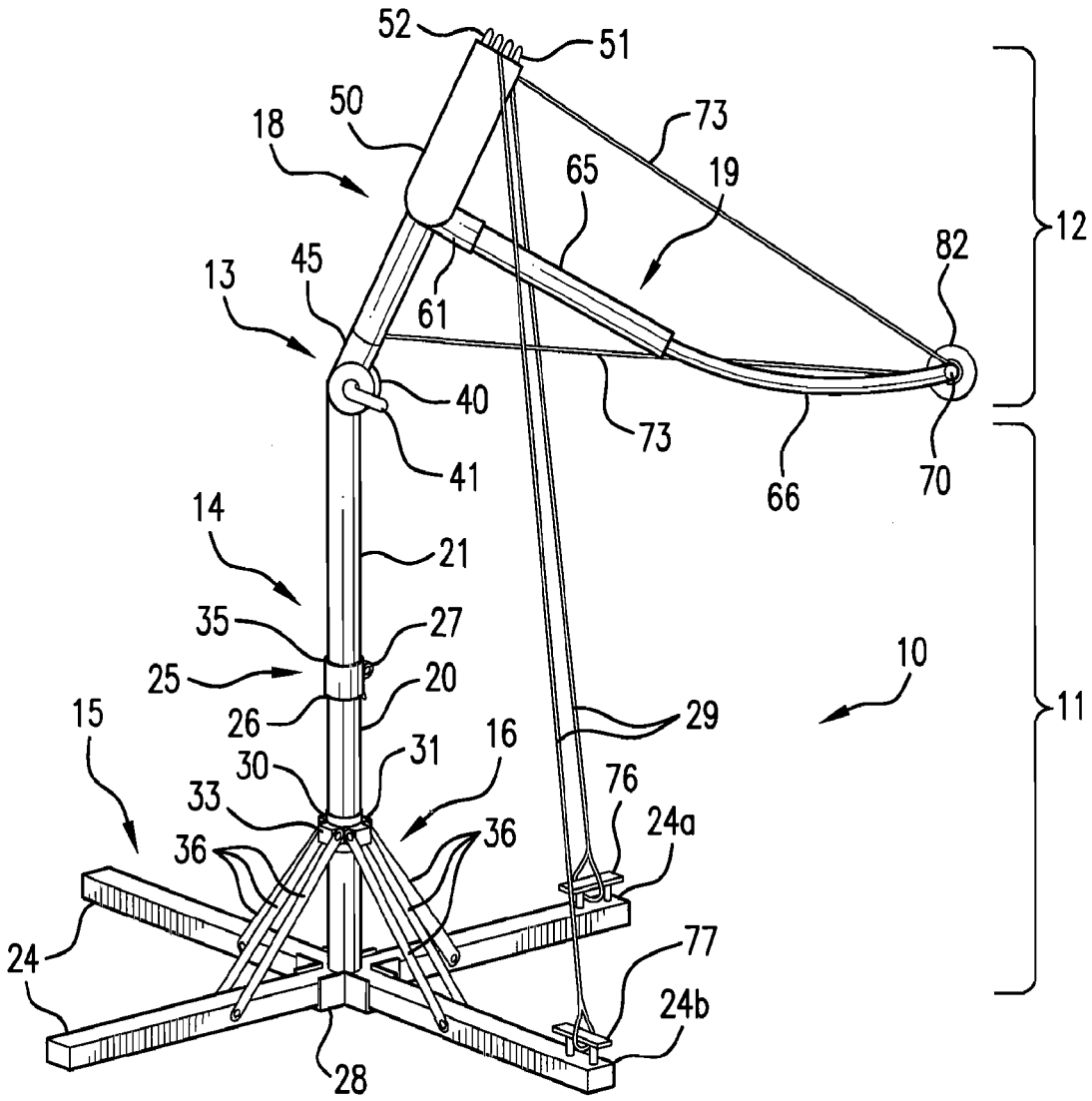
FIG. 1 is a perspective view of the Portable Target Game Training Device, in accordance with the present invention.
Figure 2:
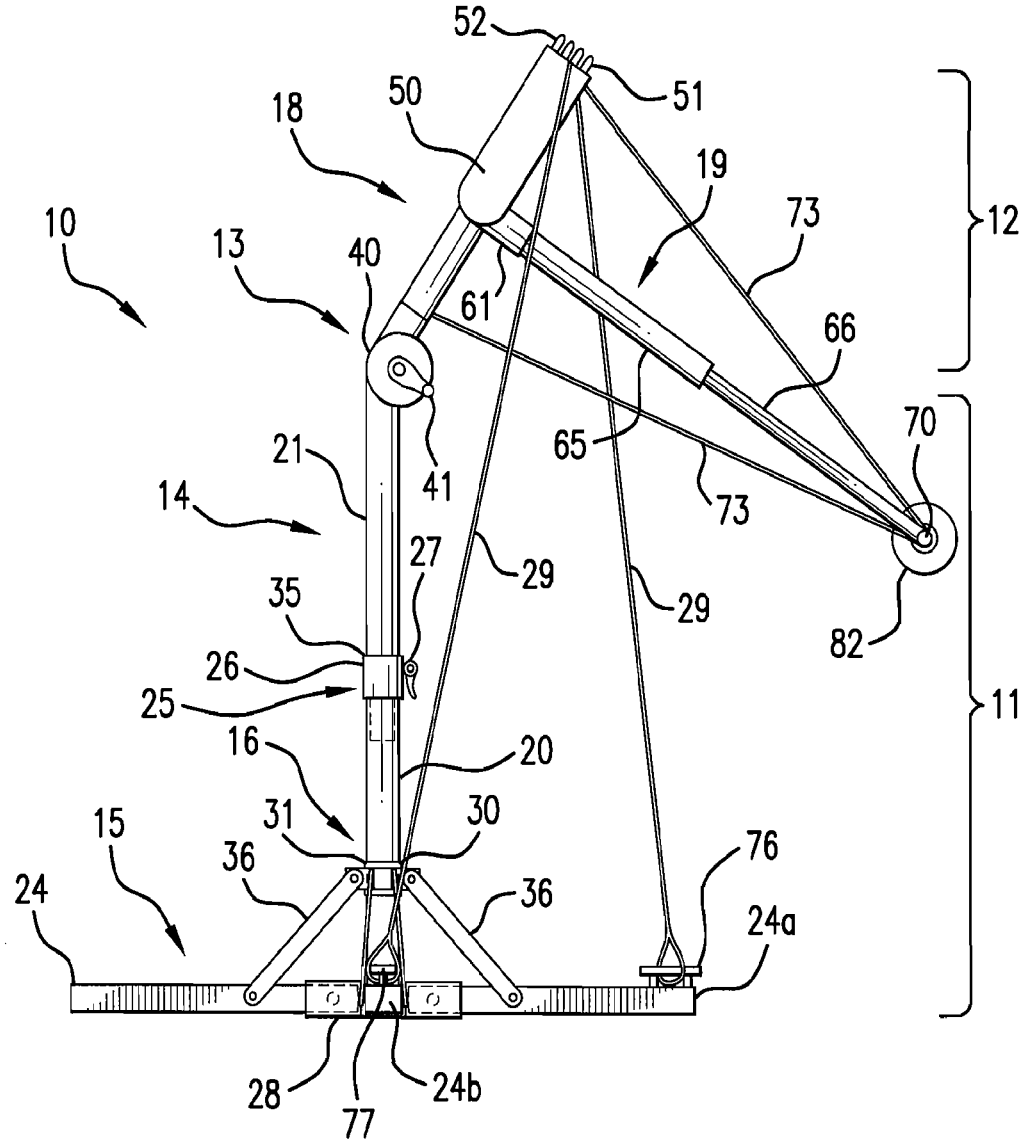
FIG. 2 is a rear elevational view of the Portable Target Game Training Device shown in FIG. 1.
Figure 3:
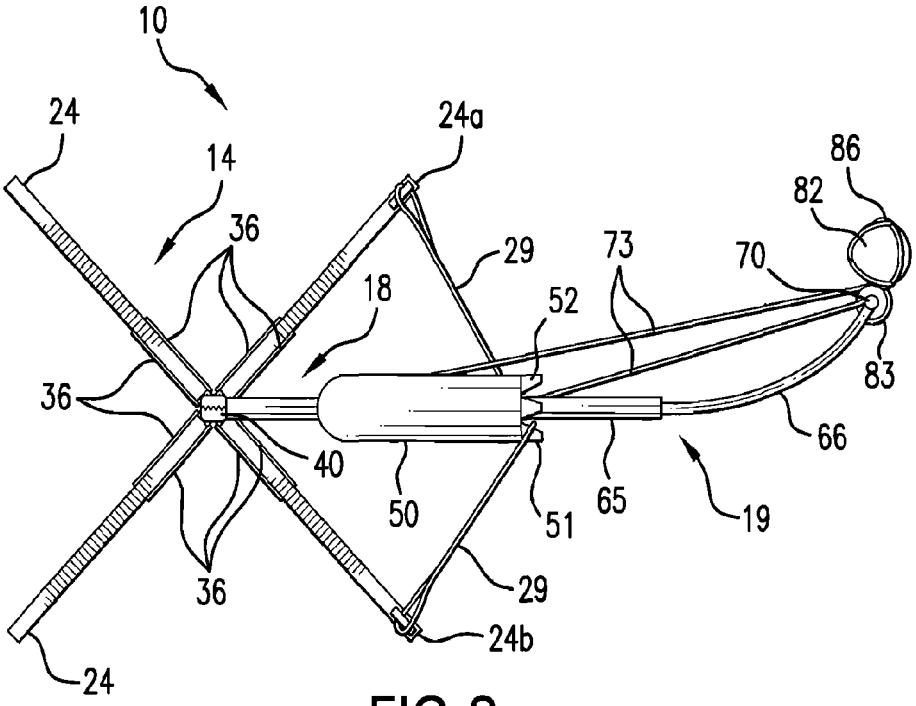
FIG. 3 is a top plan view of the Portable Target Game Training Device shown in FIG. 1.
Figure 4A:
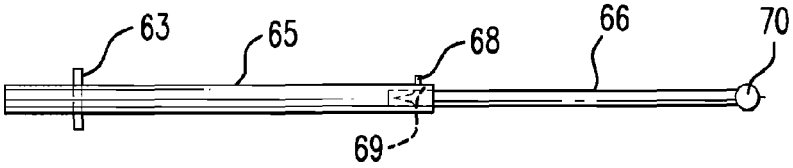
FIG. 4*a* is a top plan view of the bowable suspension support arm showing the inboard pin, and spring-loaded longitudinally positioned pin and the grooves and the telescoping relationship of its inboard and outboard members with the substantially spherically shaped member on the arm's outboard tip.
Figure 4B:
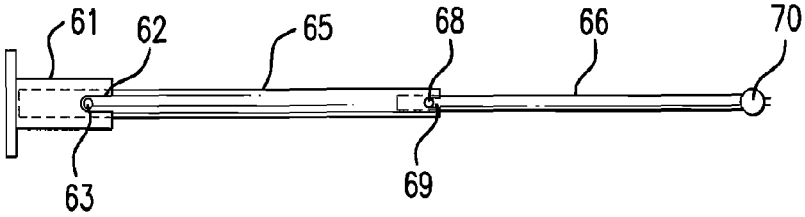
FIG. 4*b* is a side view showing the socket that is mounted on the side of the upper inclined vertical shaft with the extended suspension support arm with the substantially spherically shaped member on the arm's outboard tip.
Figure 4C:
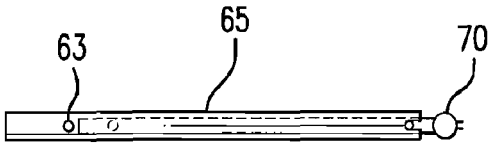
FIG. 4*c* is a side view of the suspension support arm in its collapsed position with the substantially spherically shaped member on its outboard tip.
Figure 5:
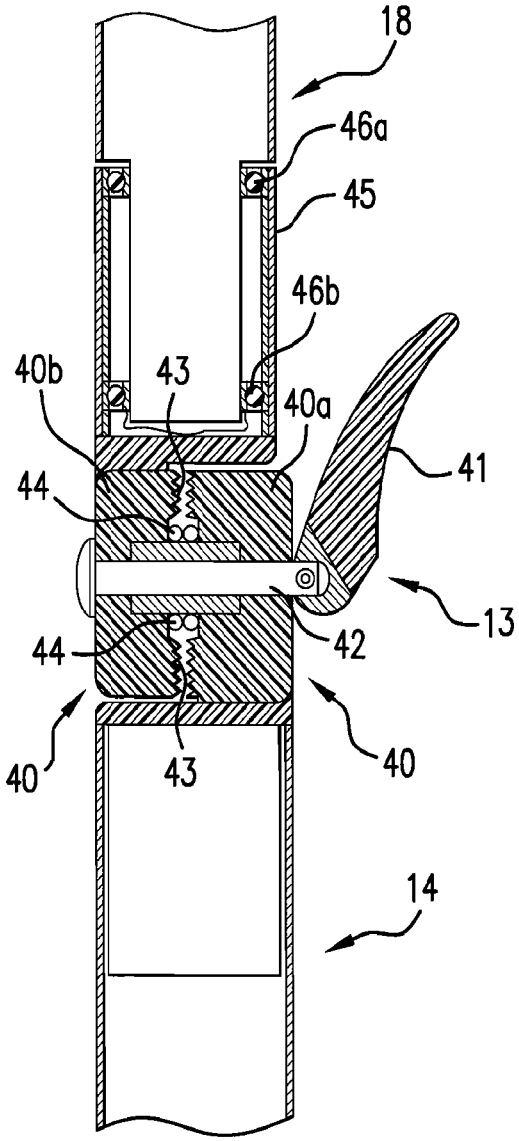
FIG. 5 is a cross-sectional view of the angular adjustment system showing the first and second pivotal coupling locking hubs and cam clamp in cut away section wherein the cam clamp is positioned in the releasing position thereof and the housing is on seated the upper bearing support and lower bearing support with the upper inclined vertical shaft mounted therein.
Figure 6:
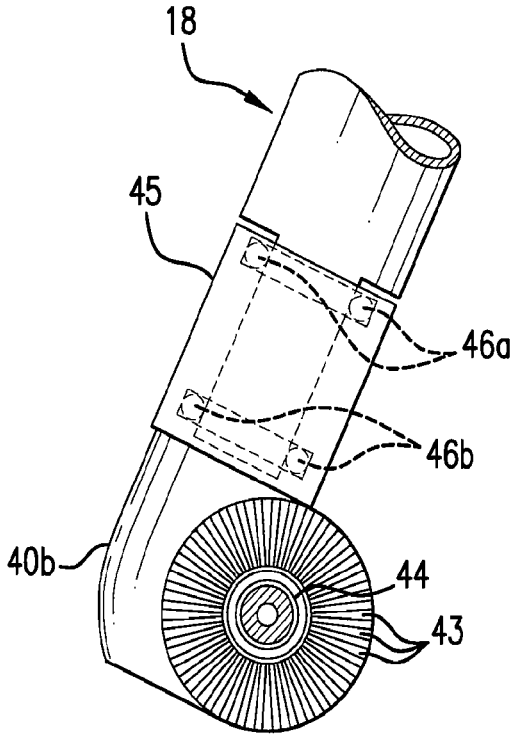
FIG. 6 is a side view of the second pivotal coupling locking hub connected to the housing which is seated in the upper bearing support and the lower bearing support and connected to the upper inclined vertical shaft.
Figure 7:
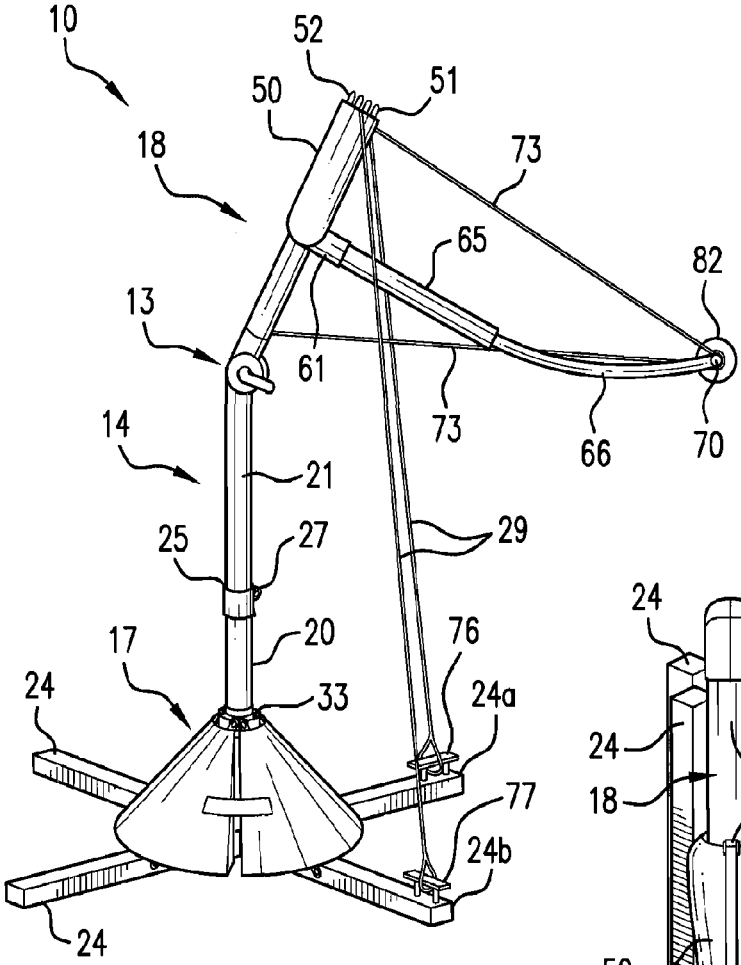
FIG. 7 is a perspective view of the Portable Target Game Training Device showing the water-filled blatter weight base.
Figure 8:
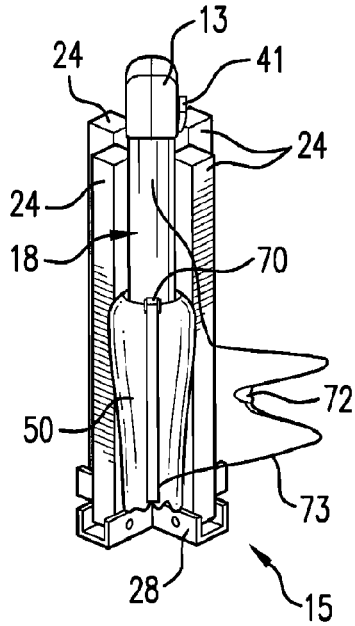
FIG. 8 is a perspective view of the Portable Target Game Training Device fully collapsed for transportation or storage.
Figure 9:
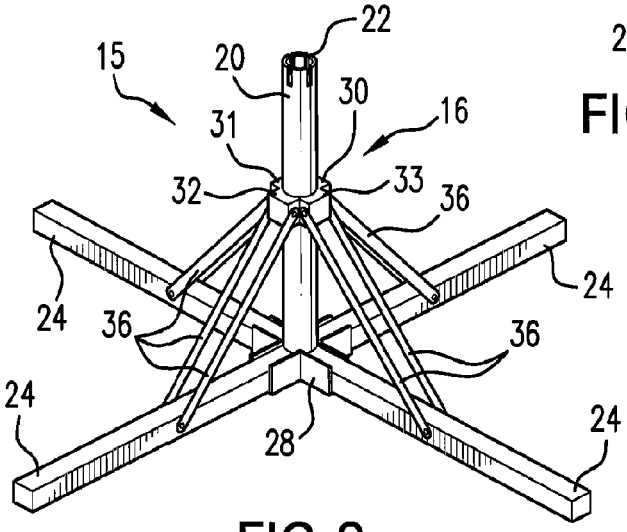
FIG. 9 is a fragmentary-perspective view of the foldable base assembly comprising the cross shaped four legs or leg means, the central leg support, and the telescopically connected lower tubular shaft, embodiment details.
Figure 10:
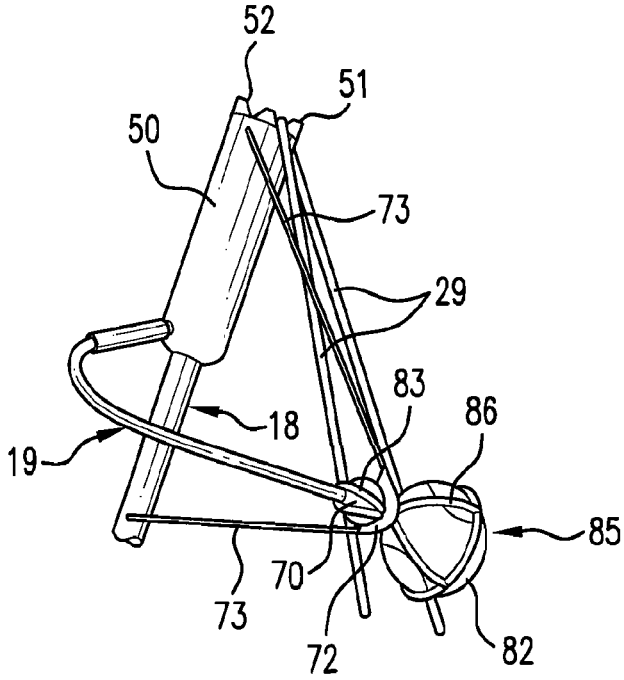
FIG. 10 is a fragmentary-perspective view of the integral target suspension system of the Portable Target Game Training Device showing attachment of the elastic cord and illustrating the assembly comprised of the suspension support arm connected to the tethered cord at the junction point of the suspension support arm with the substantially spherically shaped member connected to the tethered cord at a sling with the basket and sport target.
Figure 12A:
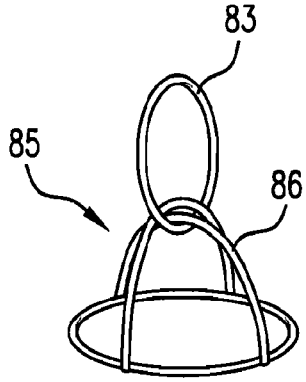
FIGS. 12*a* and 12*b* show an embodiment of a target holder with a basket and a loop.
Figure 12B:
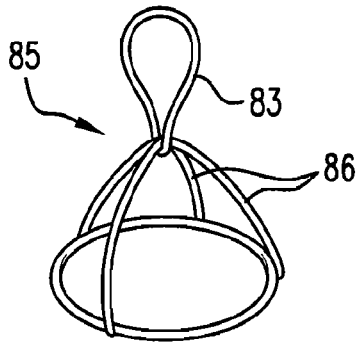
Figure 11:
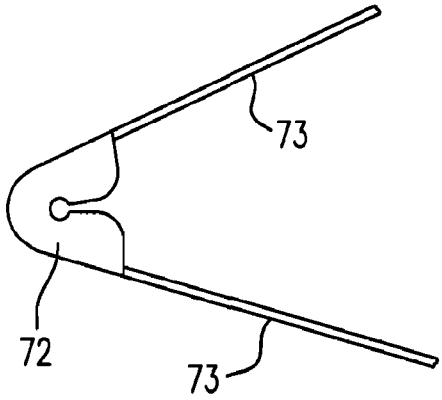
FIG. 11 is a fragmentary-perspective view showing detail of tethered cord and sling assembly.
Figure 12C:
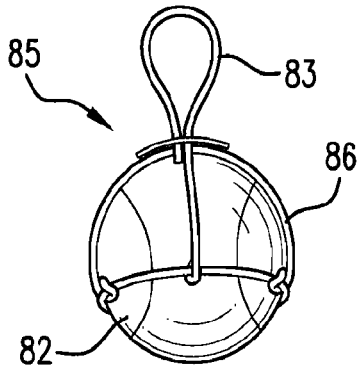
FIG. 12*c* show an embodiment of the target holder circumferentially holding a typical sport target.
Figure 13:
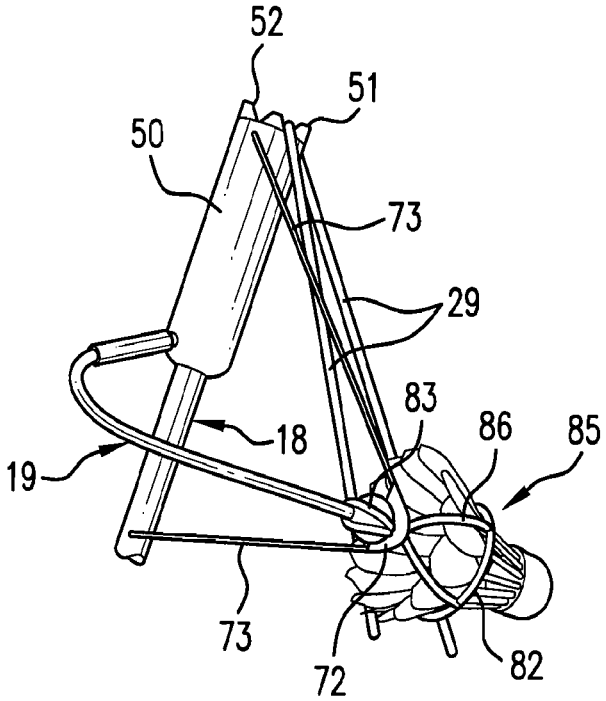
FIG. 13 is a fragmentary perspective view showing the rotatable shaft, arm, tether cord, holder, and a badminton birdie.

FIG. 1 shows the Portable Target Game Training Device 10 is comprised of a main support system 11 and an integral target suspension system 12. The main support system 11 may be comprised of four legs 15 each attached to a central leg support 28 with rivets such that each of said legs may fold inward toward said central leg support and said central leg support may be attached to a telescopically connected lower tubular shaft 20 using connecting means. A base folding mechanism 16 is composed of a central leg support 28, a telescopically connected lower tubular shaft 20, a upper tubular shaft 21, a cylinder 31, four stays 36, a clamp 33, cylinder stay support 30, and a cross set of four legs 24. Said telescopically connected lower tubular shaft 20 has mounted to it a cylinder 31 capable of traversing upwardly and downwardly said telescopically lower tubular shaft 20 and four pairs of stays 36 such that one pair is connected using metal pins to each of said legs at outboard end of a stay and at the other end to said cylinder 31 at a cylinder stay support 30 with metal pins and said cylinder 31 with a clamp 33 attached to said cylinder 31 so as to be able to clamp said cylinder 31 in a stationary position on said telescopically connected lower tubular shaft 20. A upper tubular shaft 21 is nested within said telescopically connected lower tubular shaft 20 said telescopically connected lower tubular shaft 20 and is fitted at the end remote from said central leg support 28 with said telescopically connected lower tubular shaft 20. FIG. 7 shows a water filled base weight 17 mounted around said base folding mechanism 16.

A height adjustment mechanism 25 is comprised of a support sleeve 26 is arranged inside a split collar ring 35 and a cam handle 27. Said cam handle 27 is in communication with said split collar ring 35 is such that when pressure is applied to said cam handle 27 and said cam handle 27 pivots, the bottom of the cam handle 27 draws together each end of said split collar ring 35 locking said upper tubular shaft 21 within said telescopically connected lower tubular shaft 20.

An angular adjustment system 13 is inserted into said upper tubular shaft 21 and held in place with screws at the end of said upper tubular shaft 21 remote from said height adjustment mechanism 25. A pivotal coupling locking hub unit 40 is comprised of a first pivotal locking hub 40*a* and a second pivotal locking hub 40*b*. A first pivotal coupling locking hub 40*a* attached with screws to said upper tubular shaft 21, said first pivotal coupling locking hub 40*a* having teeth 43 arranged in spherical fashion from the edge of said first pivotal coupling locking hub 40*a* toward the center of said first pivotal coupling locking hub 40*a* and a collar 44 toward the center of the teeth 43, said first pivotal coupling locking hub 40*a* having a hole through the middle of the circle of teeth 43 and expansion ring 44 and a second pivotal coupling locking hub 40*b* that is the opposite of said first pivotal coupling locking hub 40*a* such that the teeth 43 interlock with one another and said first and second pivotal coupling locking hubs 40*a*, 40*b* are held together by a pin that passes through said first pivotal locking hub 40*a* and then though said second pivotal locking hub 40*b*.

A cam handle 41 is attached to said pin so that when said cam handle 41 is pressed toward the pivotal coupling locking hubs 40*a*, 40*b* then the teeth 43 come together thereby locking the hubs 40*a*, 40*b* into position to hold the angular adjustment system 13 in any position over a range of about 220 degrees of rotation from nearly parallel to said vertical telescoping support shaft 14 with a housing 45.

Attached to said second pivotal coupling locking hub 40*b* is said housing 45 containing a lower bearing support 46*b* and a upper bearing support 46*a* with a upper inclined vertical shaft 18 set inside said lower and upper bearing supports 46*a*, 46*b* enabling said upper inclined vertical shaft 18 to rotate freely within said housing 45 along an axis perpendicular to the housing 45 and in line with said upper inclined vertical shaft 18.

The upper inclined vertical shaft 18 is crowned with a top ring 51. The top ring 51 has four slots 52. Below the top ring 51 is a collar 50 of greater diameter than the upper inclined vertical shaft 18. A tethered cord 73 is attached to the upper inclined vertical shaft 18 just below the top ring 51 and just above the housing 45. The coupling member or socket 61 is attached to the upper inclined vertical shaft 18 such that the coupling member 61 is equidistant between the two attachment points of the tethered cord 73. When assembled the suspension support arm 19 is set in the coupling member 61 such that the pin 63 is seated in the grooves 62 in coupling member 61. The suspension support arm 19 is comprised of an inner rigid tubular member 65 and an outer resilient member 66. Outer resilient member 66 nests inside inner rigid tubular member 65 and when extended longitudinally positioned pin 68 will lock into slot 69 in turn locking outer resilient member 66 and inner rigid tubular member 61 into a single member. The suspension support arm 19 is tipped with a substantially spherical shaped member with guide prongs 70. The tethered cord 73 is fitted with a sling 72. The sport target, ball, or birdie or target 82 is held in a target holder or holder 85 that is comprised of a basket 86 and a loop 83. When assembled, the suspension support arm or arm 19 is set in the coupling member 61 and the sling 72 causing the suspension support arm 19 to bow. The target holder 85 is held in place by the sling 72 and the substantially spherical shaped member with guide prongs 70. The elastic cord 29 is attached from cleat 76 on leg 24*a* to one or more slots 52 on top ring 51 and then to cleat 77 on leg 24*b* and to one or more of the slots 52 on top ring 51.

When in use, a player would strike the sport target 82 causing the integral target suspension system 12 to rotate on the axis in line with the upper inclined vertical shaft 18 causing the elastic cord 29 to tighten. The rotation would stop and reverse when the force of the tightened elastic cord 29 overcame the forward force of the player's strike. The player would then have an opportunity to strike the target again as the upper inclined vertical shaft 18 reversed rotation. Play would continue in that manner.

The invention claimed is:

1. A portable target game training device for training play by a user that elevates a target when said target is struck, such device comprising:

a base, a stand connected to said base, a rotatable shaft connected, to said stand, an arm connected to said rotatable shaft connection means between said arm and said rotatable shaft and a target secured to the remote end of said arm said arm being selectively adjustably bowed by said connection means to move said target and change and adjust said play by said user; and an elastic cord connected to said base and to said rotatable shaft connection means between said elastic cord and said base and between said elastic cord and said rotatable shaft when rotating that together accepts rotation of said shaft when said target is struck and thereafter imparts counter-rotation to said rotatable shaft said stand further comprising: an angle adjustment mechanism connected to said stand first anchoring means between said stand and said angle adjustment mechanism said rotatable shaft connected to said angle adjustment mechanism second anchoring means between said angle adjustment mechanisms and said rotatable shaft such that said angle adjustment mechanism allows said user to selectively adjust the angle between said stand and said rotatable shaft so as to tailor the arc of the trajectory of rotation of the target.

* * * * *